US009347293B2

(12) United States Patent
Samuel et al.

(10) Patent No.: US 9,347,293 B2
(45) Date of Patent: May 24, 2016

(54) METHOD AND SYSTEM OF DISPLAYING DATA ASSOCIATED WITH DRILLING A BOREHOLE

(75) Inventors: Robello Samuel, Houston, TX (US); Umesh N. Reddy, Houston, TX (US); R. Daniel Colvin, Dripping Springs, TX (US); Ramakrishna R. Chada, Cypress, TX (US); Olivier R. Germain, Houston, TX (US)

(73) Assignee: LANDMARK GRAPHICS CORPORATION, Houston, TX (US)

( * ) Notice: Subject to any disclaimer, the term of this patent is extended or adjusted under 35 U.S.C. 154(b) by 383 days.

(21) Appl. No.: 14/131,452

(22) PCT Filed: Jul. 3, 2012

(86) PCT No.: PCT/US2012/045415

§ 371 (c)(1),
(2), (4) Date: Jan. 8, 2014

(87) PCT Pub. No.: WO2013/015958

PCT Pub. Date: Jan. 31, 2013

(65) Prior Publication Data

US 2014/0135995 A1 May 15, 2014

Related U.S. Application Data

(60) Provisional application No. 61/510,550, filed on Jul. 22, 2011.

(51) Int. Cl.

| | |
|---|---|
| ***G05B 13/00*** | (2006.01) |
| ***E21B 43/00*** | (2006.01) |
| ***E21B 44/00*** | (2006.01) |
| ***E21B 7/04*** | (2006.01) |

(52) U.S. Cl.
CPC . *E21B 43/00* (2013.01); *E21B 7/04* (2013.01); *E21B 44/00* (2013.01)

(58) Field of Classification Search
CPC ..... E21B 43/00; E21B 7/04; E21B 44/00
USPC ..... 700/275; 702/9; 175/26
See application file for complete search history.

(56) References Cited

U.S. PATENT DOCUMENTS

| | | | | |
|---|---|---|---|---|
| 4,875,014 | A * | 10/1989 | Roberts | E21B 47/02224 175/26 |
| 6,155,357 | A | 12/2000 | King et al. | |
| 6,293,356 | B1 | 9/2001 | King et al. | |
| 6,389,360 | B1 * | 5/2002 | Alft | E21B 7/04 702/9 |
| 2007/0029113 | A1 | 2/2007 | Chen | |

FOREIGN PATENT DOCUMENTS

| | | | |
|---|---|---|---|
| WO | WO-2004055325 | A1 | 7/2004 |
| WO | 2010/039317 | A1 | 4/2010 |

OTHER PUBLICATIONS

PCT Search Report and Written Opinion, International Application No. PCT/US2012/045415, mailed Jan. 21, 2013.

* cited by examiner

*Primary Examiner* — Mohammad Ali
*Assistant Examiner* — Sheela S Rao

(57) ABSTRACT

Displaying data associated with drilling a borehole. At least some of the illustrative embodiments are methods including: reading data associated with drilling of a first borehole, at least one datum of the data based on a controllable parameter; calculating an operational value related to drilling the first borehole, the calculating in real-time with reading the data and the operational value based on the data; determining a target value of the operational value, the determining in real-time with reading the data and the target value at least in part based on the data; displaying a first borehole trajectory on a display device; superimposing a first coordinate system over the first borehole trajectory on the display device, the superimposing proximate to a distal end of the first borehole trajectory; and plotting, within the first coordinate system, an indication of the operational value and an indication of the target value.

28 Claims, 6 Drawing Sheets

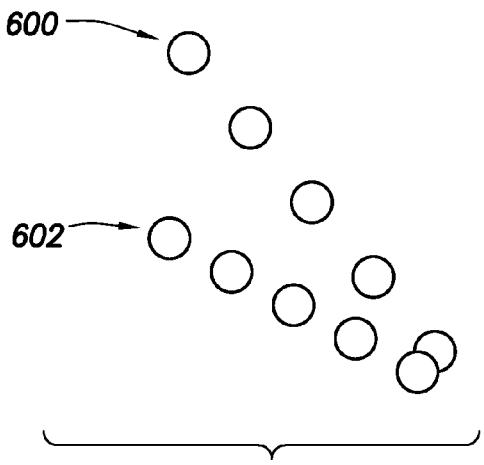
FIG.6
FIG.7
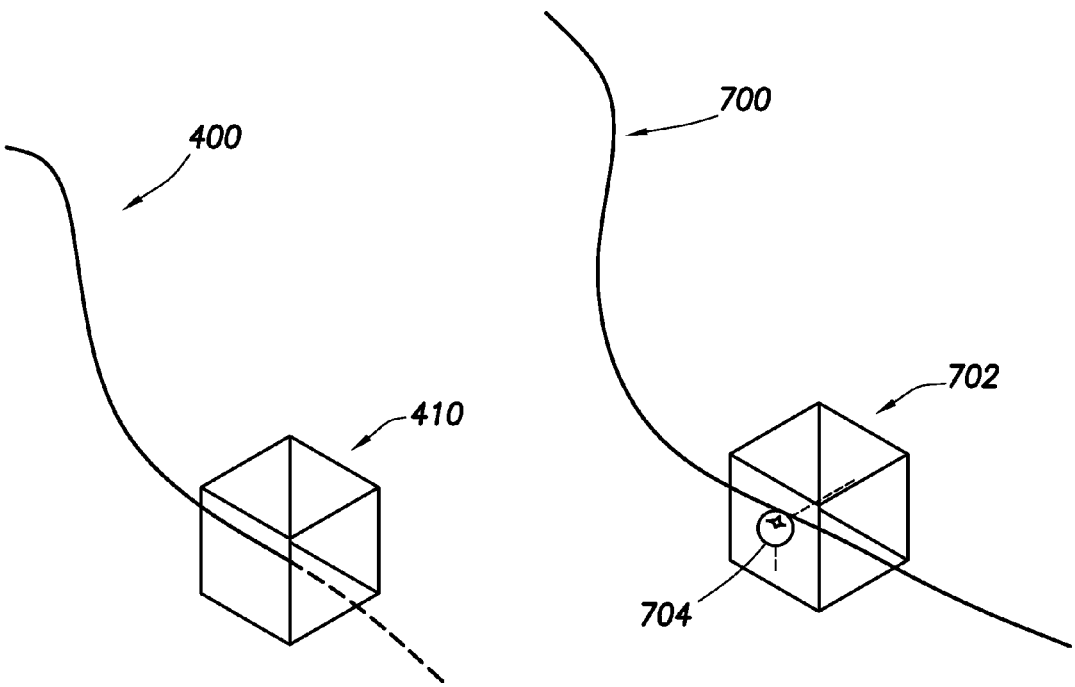

METHOD AND SYSTEM OF DISPLAYING DATA ASSOCIATED WITH DRILLING A BOREHOLE

CROSS-REFERENCE TO RELATED APPLICATIONS

This application claims the benefit of provisional application Ser. No. 61/510,550 filed Jul. 22, 2011, titled "System and method for visualizing and automating real-time drilling optimization", which provisional application is incorporated by reference herein as if reproduced in full below.

BACKGROUND

To obtain hydrocarbons such as oil and gas, boreholes are drilled by rotating a drill bit attached to a drill string. The drill bit is mounted on the lower end of the drill string as part of a bottomhole assembly (BHA) and is rotated by rotating the drill string at the surface, by actuation of downhole motors, or both. With weight applied by the drill string, the rotating drill bit engages the earth formation and forms a borehole toward a target zone.

A number of downhole devices placed in close proximity to the drill bit measure downhole operating parameters associated with the drilling and downhole conditions. Such devices may include sensors for measuring downhole temperature and pressure, azimuth and inclination of the borehole, and formation parameter-measuring devices. The recited information and other information (such as rotational speed of the drill bit and/or the drill string, and drilling fluid flow rate) may be provided to the drilling operator so that drilling plan may be implemented.

Providing information to the drilling operator requires the operator to consider many variables, some interrelated, when making decisions regarding implementing the drilling plan. However, the ability to consider and alter a large number of variables can prove difficult for a drilling operator, particularly when the variables are presented in a disparate manner.

BRIEF DESCRIPTION OF THE DRAWINGS

For a detailed description of exemplary embodiments, reference will now be made to the accompanying drawings in which:

FIG. 6 shows a plot in accordance with at least some embodiments;

FIG. 7 shows a plot on a display device in accordance with at least some embodiments.

NOTATION AND NOMENCLATURE

Certain terms are used throughout the following description and claims to refer to particular system components. As one skilled in the art will appreciate, different companies may refer to a component by different names. This document does not intend to distinguish between components that differ in name but not function.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection or through an indirect connection via other devices and connections.

"Borehole" shall mean a hole drilled into the Earth's crust used directly or indirectly for the exploration or extraction of natural resources, such as oil, natural gas or water.

"Controllable parameter" shall mean a parameter whose values may be directly or indirectly controlled during the drilling process (e.g., rotational speed of a drill bit, drilling fluid flow rate, weight-on-bit).

"Real-time", with respect to calculations based on underlying data, shall mean that the calculations are completed within six minutes of reading the underlying data.

"Remote" shall mean greater than one mile from a designated location.

"Surface", in reference to the surface of the Earth, shall mean any location starting 10 feet below the ground and extending upward relative to the local force of gravity.

DETAILED DESCRIPTION

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

The various embodiments are directed to methods and systems of displaying information for use during drilling of a borehole, and in some cases methods and systems of automating the drilling process. The specification first turns to a description of illustrative systems, and then provides a more detailed explanation of operation of various embodiments within the illustrative systems.

Figure 1:
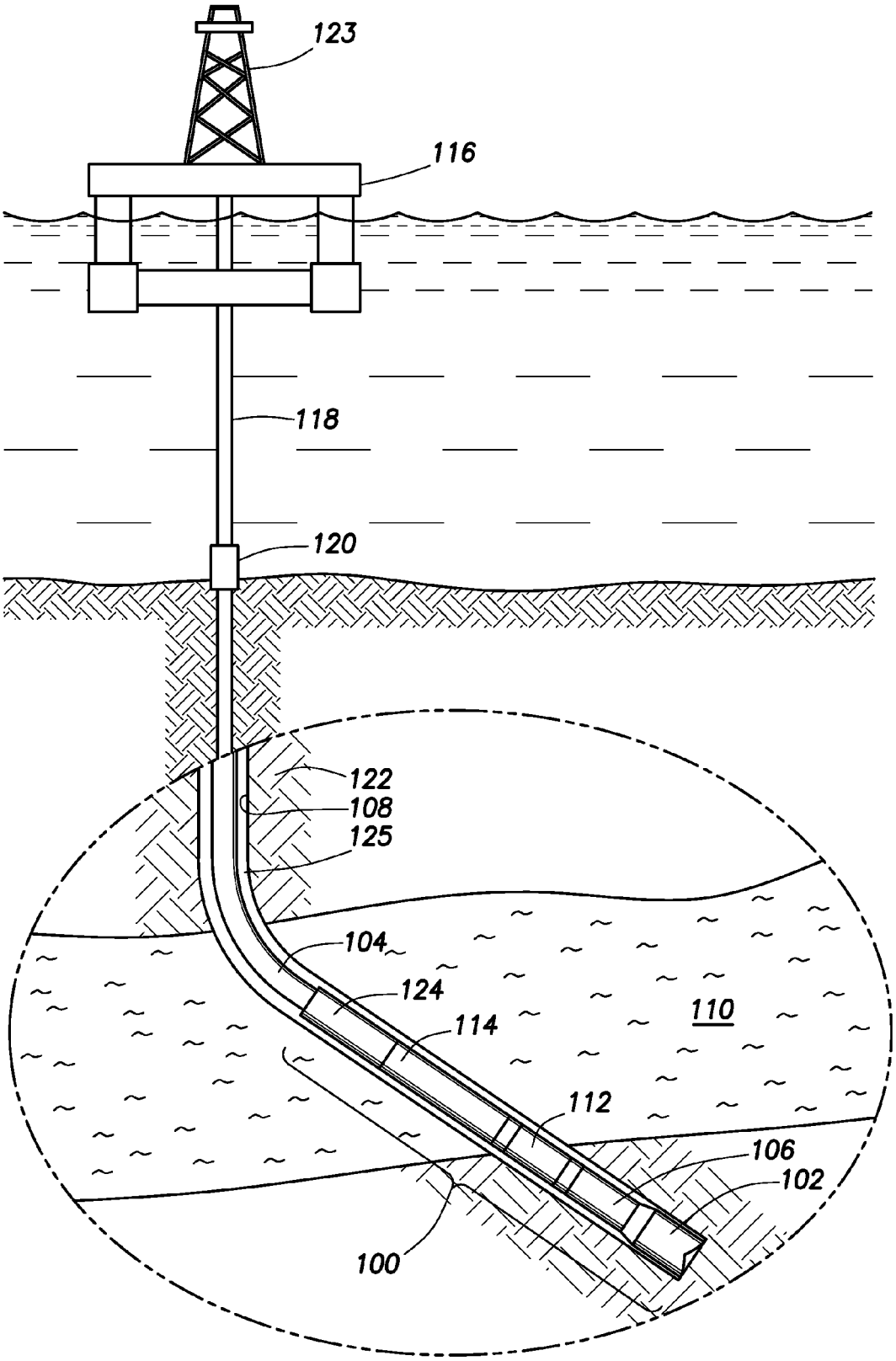
FIG. 1 shows an offshore drilling system in accordance with at least some embodiments.

FIG. 1 shows an example subsea drilling operation. In particular, FIG. 1 shows a bottomhole assembly 100 for a subsea drilling operation, where the bottomhole assembly 100 illustratively comprises a drill bit 102 on the distal end of the drill string 104. Various logging-while-drilling (LWD) and measuring-while-drilling (MWD) tools may also be coupled within the bottomhole assembly 100. The distinction between LWD and MWD is sometimes blurred in the industry, but for purposes of this specification and claims LWD tools measure properties of the surrounding formation (e.g., resistivity, porosity, permeability), and MWD tools measure properties associated with the borehole (e.g., inclination, and direction). In the example system, a logging tool 106 may be coupled just above the drill bit, where the logging tool may read data associated with the borehole 108 (e.g., MWD tool), or the logging tool 106 may read data associated with the surrounding formation (e.g., a LWD tool). In some cases, the bottomhole assembly 100 may comprise a mud motor 112. The mud motor 112 may derive energy from drilling fluid flowing within the drill string 104 and, from the energy extracted, the mud motor 112 may rotate the drill bit 102 (and if present the logging tool 106) separate and apart from rotation imparted to the drill string by surface equipment. Additional logging tools may reside above the mud motor 112 in the drill string, such as illustrative logging tool 114.

The bottomhole assembly 100 is lowered from a drilling platform 116 by way of the drill string 104. The drill string 104 extends through a riser 118 and a well head 120. Drilling equipment supported within and around derrick 123 (illustrative drilling equipment discussed in greater detail with respect to FIG. 2) may rotate the drill string 104, and the rotational motion of the drill string 104 and/or the rotational motion created by the mud motor 112 causes the bit 102 to form the borehole 108 through the formation material 122. The volume defined between the drill string 104 and the borehole 108 is referred to as the annulus 125. The borehole 108 penetrates subterranean zones or reservoirs, such as reservoir 110, believed to contain hydrocarbons in a commercially viable quantity.

In accordance with at least some embodiments, the bottomhole assembly 100 may further comprise a communication subsystem. In particular, illustrative bottomhole assembly 100 comprises a telemetry module 124. Telemetry module 124 may communicatively couple to the various logging tools 106 and 114 and receive logging data measured and/or recorded by the logging tools 106 and 114. The telemetry module 124 may communicate logging data to the surface using any suitable communication channel (e.g., pressure pulses within the drilling fluid flowing in the drill string 104, acoustic telemetry through the pipes of the drill string 104, electromagnetic telemetry, optical fibers embedded in the drill string 104, or combinations), and likewise the telemetry module 124 may receive information from the surface over one or more of the communication channels.

Figure 2:
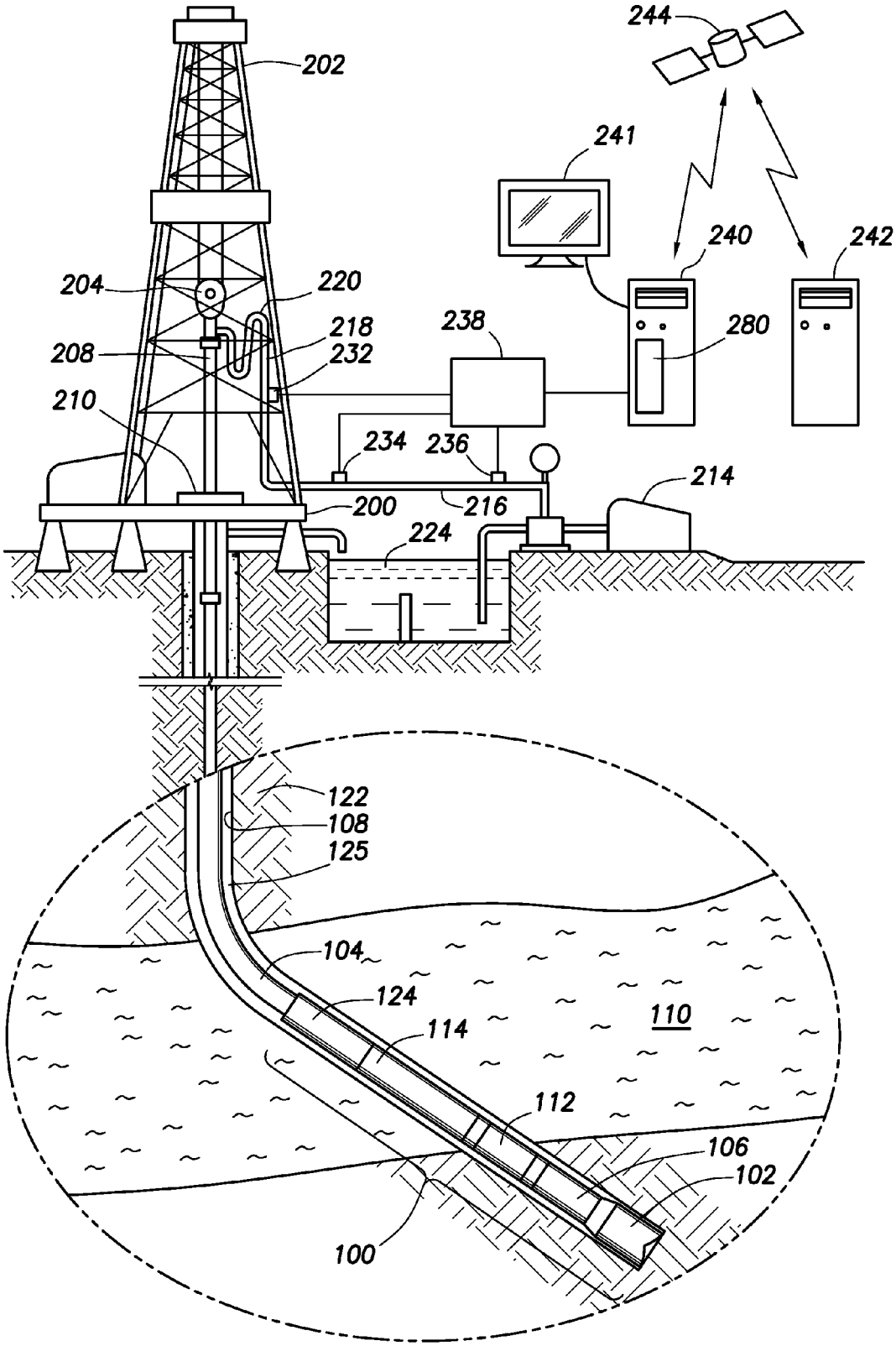
FIG. 2 shows a land-based drilling system in accordance with at least some embodiments.

FIG. 2 shows an example land-based drilling operation. In particular, FIG. 2 shows a drilling platform 200 equipped with a derrick 202 that supports a hoist 204. The hoist 204 suspends a top drive 208, the hoist 204 and top drive rotate and lower the drill string 104 through the wellhead 210. Drilling fluid is pumped by mud pump 214 through flow line 216, stand pipe 218, goose neck 220, top drive 208, and down through the drill string 104 at high pressures and volumes to emerge through nozzles or jets in the drill bit 102. The drilling fluid then travels back up the wellbore via the annulus 125, through a blowout preventer (not specifically shown), and into a mud pit 224 on the surface. On the surface, the drilling fluid is cleaned and then circulated again by mud pump 214. The drilling fluid is used to cool the drill bit 102, to carry cuttings from the base of the borehole to the surface, and to balance the hydrostatic pressure in the rock formations.

In the illustrative case of the telemetry mode 124 encoding data in pressure pulses that propagate to the surface, one or more transducers, such as transducers 232, 234 and/or 236, convert the pressure signal into electrical signals for a signal digitizer 238 (e.g., an analog-to-digital converter). While three transducers 232, 234 and/or 236 are illustrated, a greater number of transducers, or fewer transducers, may be used in particular situations. The digitizer 238 supplies a digital form of the pressure signals to a surface computer 240 or some other form of a data processing device. Surface computer 240 operates in accordance with software (which may be stored on a computer-readable storage medium) to monitor and control the drilling processing, including instructions to process and decode the received signals related to telemetry from downhole. The surface computer 240 is communicatively coupled to many devices in and around the drilling site, and such communicative couplings are not shown so as not to unduly complicate the discussion.

In some cases, data gathered from in and around the drill site, as well as the logging data sent by the telemetry module 124, may be displayed on a display device 241 (display techniques discussed more below). In yet still other example embodiments, the surface computer 240 may forward the data to another computer system, such as a computer system 242 at the operations center of the oilfield services provider, the operations center remote from the drill site. The communication of data between computer system 240 and computer system 242 may take any suitable form, such as over the Internet, by way of a local or wide area network, or as illustrated over a satellite 244 link. Some or all of the calculations associated with controlling the drilling may be performed at the computer system 242. The specification now turns to displaying drilling status and/or controlling the drilling in accordance with at least some embodiments.

The various embodiments were developed in the context of controlling rate-of-penetration (ROP) of the drill bit through earth formations. The discussion that follows is based on the developmental context; however, the developmental context and related discussion shall not be read as a limitation as to the scope of the various claims below. The techniques discussed in terms of rate-of-penetration find applicability to any of a variety of drilling parameters.

The drilling of the borehole may proceed through various types of formations. It follows that the downhole operating conditions change over time, and the drilling operator reacts to such changes by adjusting controllable parameters. Example controllable parameters comprise weight-on-bit (WOB), drilling fluid flow through the drill pipe (flow rate and pressure), rotational speed of the drill string (e.g., rotational rate applied by the top drive unit), and the density and viscosity of the drilling fluid. Thus, in drilling operations, the drilling operator continually adjusts the various controllable parameters in an attempt to increase and/or maintain drilling efficiency. Moreover, even with a particular formation, adjustments may be needed to increase and/or maintain drilling efficiency.

Illustrative surface computer 240 couples to the display device 241 and displays on the display device a graphic for visually tracking the drilling operations. In some embodiments, various aspects are executed within an integration and visualization platform, such as surface computer 240 executing DecisionSpace® available from Halliburton Energy Services, Inc. of Houston, Tex. The integration and visualization platform receives indications of downhole operating conditions and controllable parameters (e.g., weight-on-bit, fluid flow rate, and bit speed). The surface computer 240 also sends control signals to change various controllable parameters (e.g., weight-on-bit, drilling fluid flow rate, and bit speed).

Figure 3:
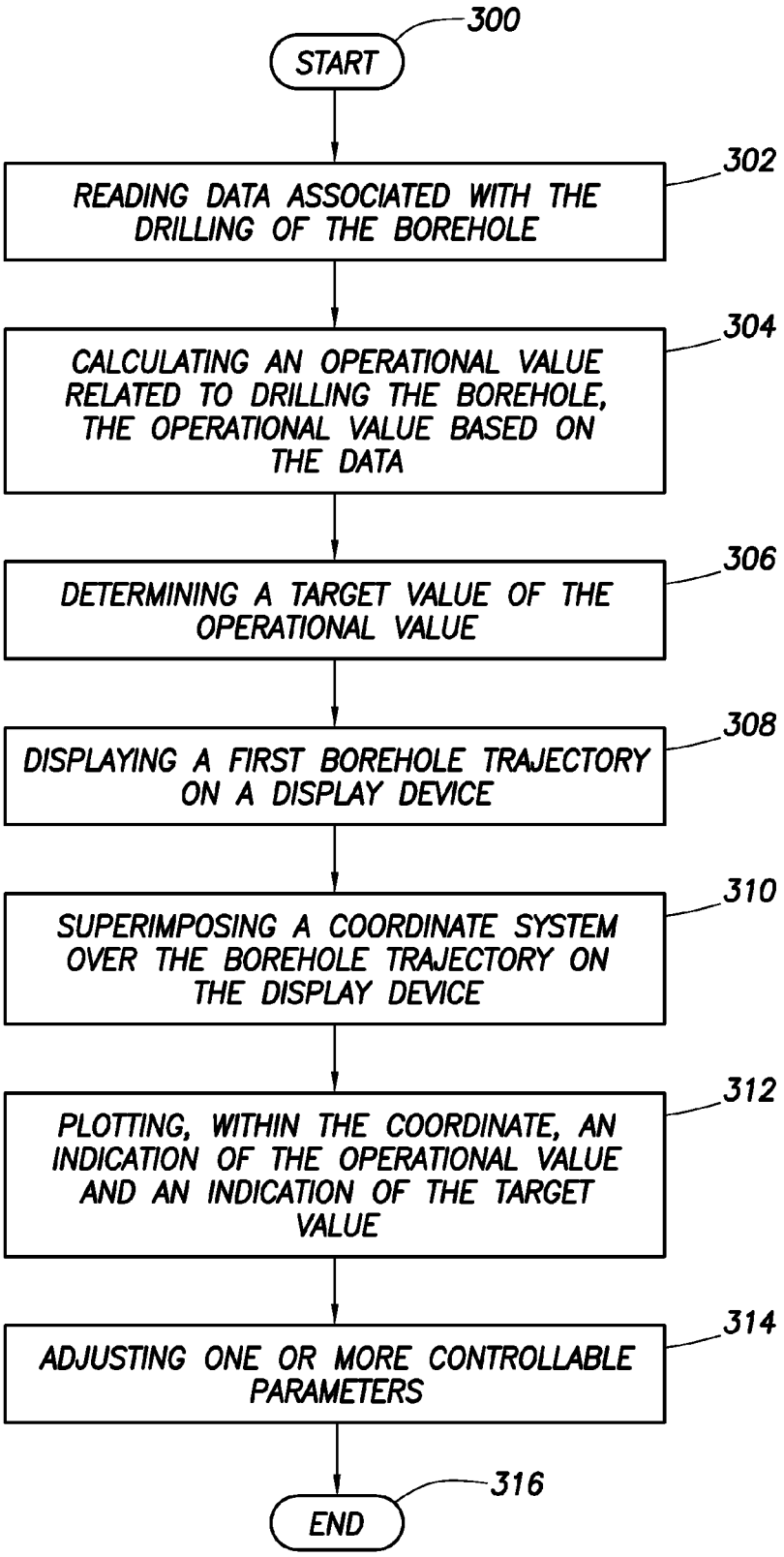
FIG. 3 shows a method in accordance with at least some embodiments.

In accordance with various embodiments, software plug-in 280 may be installed and executed by the surface computer 240 along with the integration platform. In other cases, the functionality of the plug-in 280 may be: incorporated into the integration platform; executed on the remote computer system 242; or the functionality spread among the available computer systems. The plug-in 280 may be stored in, for example, one or more computer-readable mediums. FIG. 3 shows a method that may be implemented, in whole or in part, by the plug-in 280. In particular, the method starts (block 300) and proceeds to reading data associated with the drilling of the borehole (block 302). Inasmuch as the information is to be provided to the drilling operator and is to be used to control an ongoing drilling process, the reading of the data is during the drilling process, and at least one datum of the data is based on a controllable parameter (e.g., weight-on-bit, fluid flow rate, and bit speed). The illustrative method then proceeds to calculating an operational value related to drilling the borehole, the operational value based on the data (block 304). For example, calculating the operational value may involve calculating a current rate-of-penetration for the drilling process. Here again, since the operational value is to be provided to the drilling operator for use in controlling an ongoing drilling process, the calculating is in real-time with reading of the data.

Still referring to FIG. 3, the next step in the illustrative method implemented by the plug-in 280 is determining a target value of the operational value (block 306), the target value based at least in part on the data associated with the drilling process. In the example case of the operational value being current rate-of-penetration, the target value may be a target rate-of-penetration, including target values for each controllable parameter that affects rate-of-penetration (e.g., weight-on-bit, fluid flow rate, and rotational speed). As yet another example, the target value may be calculated to reduce mechanical specific energy, reduce hydro-mechanical specific energy, or to reduce overall cost of drilling the borehole. In the specific example of rate-of-penetration as the operational value, the target value may be a target rate-of-penetration that reduces another value (e.g., surface energy consumption), and thus the target value need not always be calculated to optimize the operational value itself. Here again with respect the target value, since (as discussed more below) the target value is to be provided to the drilling operator for use in controlling an ongoing drilling process, the calculating of the target value is in real-time with reading of the underlying data. In some embodiments, multiple versions of the illustrative method may be executing simultaneously, each method providing respective information regarding respective (but distinct) operational values. In this way, the operator may view multiple results to ascertain patterns (e.g., both methods indicate a similar change desirable).

Figure 4:
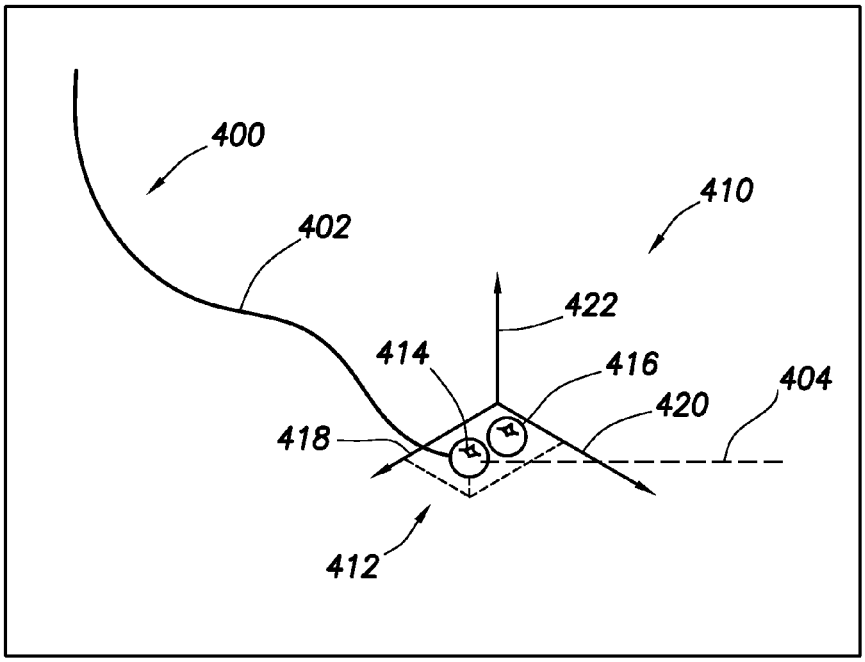
FIG. 4 shows a plot on a display device in accordance with at least some embodiments.

The illustrative method then proceeds to displaying a first borehole trajectory on a display device (block 308). That is, to aid the drilling operator in visualizing the current state of drilling the borehole, the computer system 240 illustratively executing the plug-in 280 may display on the display device 241 a depiction of the borehole trajectory, as illustrated in FIG. 4. In particular, FIG. 4 shows a view of a borehole trajectory 400 that may be shown on the display device 241. In some cases, the borehole trajectory 400 may comprise an indication of the portion of the borehole that has already been drilled (in FIG. 4 by portion 402 shown with a solid line), and also an indication of the expected future path of the borehole that has yet to be drilled (in FIG. 4 by portion 404 shown with a dashed line). In other cases, the expected future path may be omitted from the display. In some embodiments, the borehole trajectory 400 may be a three-dimensional representation of the borehole, and thus the three-dimensional representation may be projected onto the two-dimensional surface of the display device in such a way as to appear to the drilling operator as three-dimensional. In other cases, the borehole trajectory 400 may be a two-dimensional representation displayed on the display device 241.

Referring simultaneously to FIGS. 3 and 4, the illustrative method may further comprise superimposing a coordinate system over the borehole trajectory on the display device (block 310). In some cases, the superimposed coordinate system may reside proximate to a distal end of the borehole trajectory. FIG. 4 illustratively shows a three-dimensional coordinate system 410 superimposed over the distal end 412 of the borehole trajectory (e.g., the current distal end of the borehole, not necessarily the planned ultimate distal end of the borehole trajectory). In other cases, a two-dimensional coordinate system may be used. In accordance with at least some embodiments, the coordinate system 410 has at least one non-spatial axis, and in some cases each axis is a non-spatial axis. Stated oppositely, in some embodiments there are no spatial axes in the coordinate system 410. Thus, the path of borehole trajectory 400, being a spatial path, may be considered to be plotted against a spatial coordinate system (which spatial coordinate system may or may not be specifically shown), and the coordinate system 410 is separate and apart from any spatial coordinate system for the borehole trajectory 410.

The illustrative method may further comprise plotting, within the coordinate system, an indication of the operational value and an indication of the target value (block 312). In FIG. 4, the target value is illustratively plotted as ball or dot 414, and the target value is illustratively plotted as a ball or dot 416. FIG. 4 thus shows an example situation where there is a difference between the operational value as calculated, and the target value. Consider the example situation of rate-of-penetration. Rate-of-penetration may be controlled by parameters such as weight-on-bit, rotational speed of the drill bit, and drilling fluid flow rate. Thus, in accordance with these embodiments the coordinate system 410 has a weight-on-bit axis 418, a rotational speed of the drill bit axis 420, and a drilling fluid flow rate axis 422. The dot 414 showing the current operational value in the form a rate-of-penetration may thus be plotted within the coordinate system 410 at a location that corresponds to the weight-on-bit, rotational speed of the drill bit, and drilling fluid flow rate that provides the current rate-of-penetration. The target value in this example situation is shown by dot 416, which dot 416 is plotted in the coordinate system 410 at a weight-on-bit, rotational speed of the drill bit, and drilling fluid flow rate that, if utilized, should provide the target rate-of-penetration.

Figure 5:
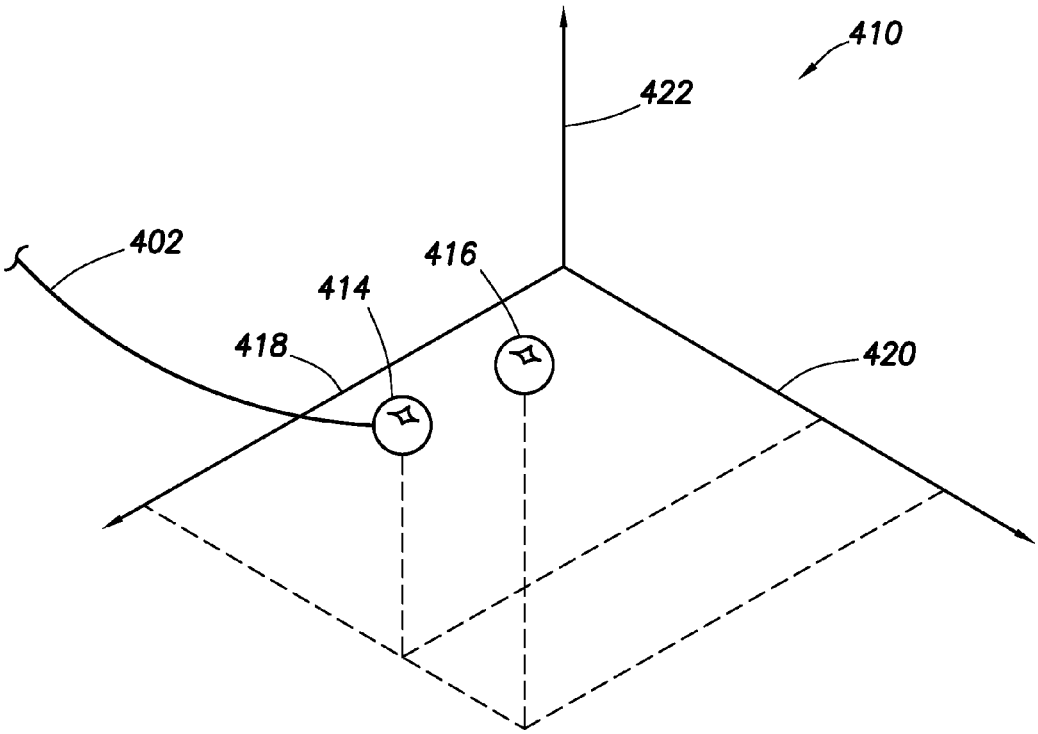
FIG. 5 shows a portion of a plot in accordance with at least some embodiments.

FIG. 5 shows a plot being a portion of the view of FIG. 4, but in greater detail. In particular, FIG. 5 shows the operational value dot 414 plotted at a location within the coordinate system 410 corresponding to the parameters that make up the operational parameter. In the illustrative case of the operational value being rate-of-penetration, dot 414 represents a rate of penetration based on: the current weight-on-bit plotted with respect to the weight-on-bit axis 418; the current rotational speed of the drill bit with respect to the rotational speed axis 420; and the current drilling fluid flow rate with respect to the drilling fluid flow rate axis 422. In the illustrative situation of FIG. 5, the target value plotted as dot 416 is different than the operational value, and the target value dot 416 plotted at a location within the coordinate system 410 corresponding to the parameters that should be required to make the operational parameter value match the target value. Again in the illustrative case of FIG. 5, the target value should be achieved with the current weight-on-bit (i.e., the operational value and target value share a weight-on-bit plotted point, but with increases in both rotational speed and drilling fluid flow rate).

The illustrative coordinate system has three non-spatial axes; however, an additional dimension may be encoded in the visual display in the form of a recognizable artifact. Still referring to FIG. 5, the magnitude of the calculated operational value may be shown in the form of the size of the dot 414. In the illustrative case of FIG. 5, the target value is greater than the current operational value, and the size of the dot 416 is increased. Stated otherwise, an additional dimension of information is thus encoded in the size of the dots plotting the operational value and target value. Other recognizable artifacts include differences in color, shape, opacity, or combinations. Further still, the magnitude of the current operational value may be displayed in number form in, on, around or near the plotted dot.

Thus, by viewing the coordinate system 410 associated with the borehole trajectory 400 plotted on the display device 241, the drilling operator is provided a wealth of information regarding the drilling processing, and can choose one or more controllable parameters for adjustment in an attempt to have the operational value move toward target value. In the illustrative case of the operational value being rate-of-penetration in the example of FIG. 5, the drilling operation may increase rotational speed of the bit, and likewise increase drilling fluid flow rate. In yet still other cases, the plug-in 280, implementing the illustrative method of FIG. 3, may determine the difference between the parameters that make up the location of the current operational value and the parameters that, if used, should cause the system to achieve the target value, and automatically adjust one or more controllable parameters (i.e., adjust one or more of the controllable parameters without input from the human drilling operator) (block 314). Thereafter, the method may end (block 316), in most cases to be immediately restarted for the next incremental depth and/or length of the borehole. As an example of the automatic adjustment, the plug-in 280 may implement one or more proportional-integral-differential (PID) control loops (e.g., one for each controllable parameter), which PID control loops continually adjust the controllable parameters in an attempt to have the operational value match the target value. In yet still further cases, the plug-in 280 may suggest to the drilling operator a change in one or more controllable parameters, and have the drilling operator make the changes after application of human intuition.

In accordance with various embodiments, as the actual drilled length of the borehole increases, so too does the length of the depiction of the borehole trajectory 400 on the display device. As the length of the borehole trajectory increases, the coordinate system moves relative to the borehole trajectory. In some cases, the coordinate system may remain at a fixed location on the display device 241, and the depiction of the borehole trajectory shifts. In other cases, previously plotted portions of the borehole trajectory 400 remain at stationary locations on the display device, and the coordinate system 410 moves to the new distal end of the borehole trajectory. In some cases, the plotted indications of the operational value and target value are removed and re-plotted with each new location of the coordinate system 410 relative to the borehole trajectory 400. However, in yet still other cases, older plotted operational value and target value are left in place (or re-plotted within the new location of the coordinate system relative to the borehole trajectory) such that the change over time in the values may be observed by the drilling operator. FIG. 6 shows a plot being a portion of what may displayed on a display device 241 by the plug-in 280 in yet still further embodiments. In particular, FIG. 6 shows a series of plotted dots, where the upper dots 600 represent previous operational values, and the lower dots 602 represent previous target values. Stated otherwise, the plug-in 280 in these embodiments may refrain from removing previous plotted values from the display device 241. Viewing a scene including the previous plotted values as in FIG. 6 thus provides feedback to the drilling operator as to how well previous changes to controllable parameters are affecting the operational value relative to the target value. The specification now turns to use of actual values from nearby wells.

While in some embodiments the plug-in 280 operates with data collected solely with respect the borehole being drilled, in other embodiments data related to other boreholes (e.g., boreholes whose drilled length is longer the current borehole being drilled, or perhaps boreholes whose drilling has been completed) may be used in various ways. FIG. 7 shows a plot that may be displayed on the display device 241 in accordance with at least some embodiments. In particular, FIG. 7 shows the borehole trajectory 400 for the current borehole being drilled, along with a coordinate system 410, in this case illustratively shown as a cube (e.g., a three-dimensional coordinate system). Co-plotted on the same display is a borehole trajectory for a nearby borehole 700, including a coordinate system 702 (also illustrative shown as a cube). Thus, in some embodiments the method executed by the plug-in 280 may include scanning one or more databases of information for the presence of nearby boreholes that are being drilled or have been drilled. For example, the plug-in 280 may access a database on the computer system 242 at the operations center for the service provider.

More particularly, the plug-in 280 may determine the proximity of nearby boreholes that have already drilled through the formation material which is or is about to be drilled by the current borehole. The idea being that the actual values associated with the nearby borehole may provide a better set of target value for the current borehole than the plug-in 280 could create based on models or characteristic equations. For example, if the borehole associated with borehole trajectory 700 has already drilled though a target shale formation, the actual rates-of-penetration achieved in the nearby borehole may be a better indication of how to set controllable parameters in the current borehole. Thus, in these embodiments the plug-in 280 may show the borehole trajectory 700, coordinate system 702, as well as a plot or dot 704 indicative of the actual value achieved in the nearby borehole. The drilling operation may thus use the indications of the controllable parameters from the nearby borehole as a guide to setting the controllable parameters in the current borehole to achieve the target value. In yet still other cases, rather than calculating a target value regarding the current borehole, the plug-in 280 may instead plot within the coordinate system 410 associated with the current wellbore the actual value achieved in the nearby borehole as the target value.

Again using the rate-of-penetration as a guide, the plug-in 280 may scan one or more data bases for nearby boreholes, and in some cases the radius or other distance criteria may be selectable (e.g., along a mineral lease line). If a nearby well meets the distance criteria, the plug-in 280 may find data regarding a corresponding depth, and the actual rate-of-penetration achieved (including the values of the controllable parameters used). The plug-in 280 may then substitute the actual rate-of-penetration from the nearby well to be the target value in the current borehole, and plot the target value rate-of-penetration along with the operational value rate-of-penetration in the coordinate system 410.

Numerous variations and modifications to the illustrative system are possible. For example, the number of dimensions shown on the coordinate system 410 is not limited to two or three, and thus the coordinate system may be an n-dimensional space. Four or more dimensions may be plotted as the dimensions need not be orthogonally related. The system may be operated in the "scan mode"—scanning for nearby boreholes such that actual values from those nearby wells may be used—or the system may be operated where only the data related to the current borehole is used. The previously plotted operational values and target values may be animated in a repeating loop to show the progression over time. The system may enable the drilling operator to "play back" the drilling situation starting from any previous depth or time to any target depth or time, including the present.

In yet still other cases, the target value calculated and displayed may be a limit value. That is, in these embodiments rather than calculating a target values (e.g., an optimized rate-of-penetration), the target value may merely plot a limit to the operational value (e.g., a maximum limit, minimum limit, deviation limit).

Further still, while the various embodiments have been described in relation to the various calculations being performed at the surface, in yet still further cases some or all calculations regarding the operational value and/or the target value may be performed by a processor disposed within the borehole proximate to the drill bit. For example, the telemetry module 124 may be a computer system (controlling an encoding system, such as a mud pulser). The computer system associated with the telemetry module 124 may calculate the various parameters, and telemeter the some or all the parameters to the surface computer systems. In cases where control of the operational parameter is automated, the telemetry module 124 (or some other sub-surface computer system) may control or change one or more controllable parameters (e.g., speed of the mud motor 112, or weight-on-bit in systems where weight-on-bit is controllable downhole).

Figure 8:
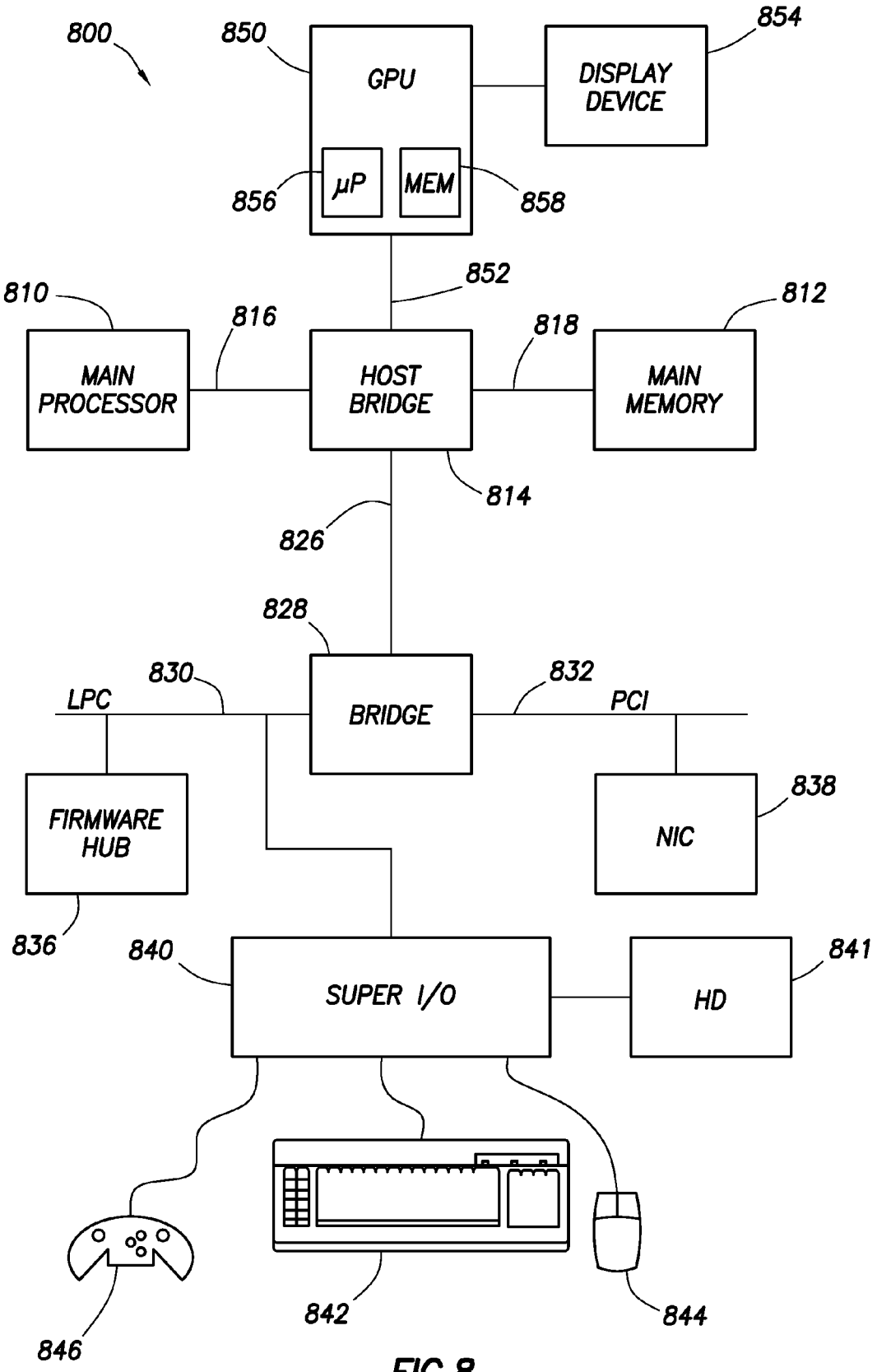
FIG. 8 shows a computer system in accordance with at least some embodiments.

FIG. 8 illustrates a computer system 800 in accordance with at least some embodiments. Computer system 800 is illustrative of a computer system upon which some or all of the various methods may be performed. For example, computer system 800 may be illustrative of computer system 240 or 242. Moreover, in slightly reduced form (e.g., without the graphics capability, network interface card, and input/output devices), computer system 800 may be representative of a computer system disposed with telemetry module 124. In particular, computer system 800 comprises a main processor 810 coupled to a main memory array 812, and various other peripheral computer system components, through integrated host bridge 814. The main processor 810 may be a single processor core device, or a processor implementing multiple processor cores. Furthermore, computer system 800 may implement multiple main processors 810. The main processor 810 couples to the host bridge 814 by way of a host bus 816, or the host bridge 814 may be integrated into the main processor 810. Thus, the computer system 800 may implement other bus configurations or bus-bridges in addition to, or in place of, those shown in FIG. 8.

The main memory 812 couples to the host bridge 814 through a memory bus 818. Thus, the host bridge 814 comprises a memory control unit that controls transactions to the main memory 812 by asserting control signals for memory accesses. In other embodiments, the main processor 810 directly implements a memory control unit, and the main memory 812 may couple directly to the main processor 810. The main memory 812 functions as the working memory for the main processor 810 and comprises a memory device or array of memory devices in which programs, instructions and data are stored. The main memory 812 may comprise any suitable type of memory such as dynamic random access memory (DRAM) or any of the various types of DRAM devices such as synchronous DRAM (SDRAM), extended data output DRAM (EDODRAM), or Rambus DRAM (RDRAM). The main memory 812 is an example of a non-transitory computer-readable medium storing programs and instructions, and other examples are disk drives and flash memory devices.

The illustrative computer system 800 also comprises a second bridge 828 that bridges the primary expansion bus 826 to various secondary expansion buses, such as a low pin count (LPC) bus 830 and peripheral components interconnect (PCI) bus 832. Various other secondary expansion buses may be supported by the bridge device 828.

Firmware hub 836 couples to the bridge device 828 by way of the LPC bus 830. The firmware hub 836 comprises read-only memory (ROM) which contains software programs executable by the main processor 810. The software programs comprise programs executed during and just after power on self-test (POST) procedures as well as memory reference code. The POST procedures and memory reference code perform various functions within the computer system before control of the computer system is turned over to the operating system. The computer system 800 further comprises a network interface card (NIC) 838 illustratively coupled to the PCI bus 832. The NIC 838 acts to couple the computer system 800 to a communication network, such the Internet, or local- or wide-area networks.

Still referring to FIG. 8, computer system 800 may further comprise a super input/output (I/O) controller 840 coupled to the bridge 828 by way of the LPC bus 830. The Super I/O controller 840 controls many computer system functions, for example interfacing with various input and output devices such as a keyboard 842, a pointing device 844 (e.g., mouse), a pointing device in the form of a game controller 846, various serial ports, floppy drives and disk drives. The super I/O controller 840 is often referred to as "super" because of the many I/O functions it performs.

The computer system 800 may further comprise a graphics processing unit (GPU) 850 coupled to the host bridge 814 by way of bus 852, such as a PCI Express (PCI-E) bus or Advanced Graphics Processing (AGP) bus. Other bus systems, including after-developed bus systems, may be equivalently used. Moreover, the graphics processing unit 850 may alternatively couple to the primary expansion bus 826, or one of the secondary expansion buses (e.g., PCI bus 832). The graphics processing unit 850 couples to a display device 854 which may comprise any suitable electronic display device upon which any image or text can be plotted and/or displayed. The graphics processing unit 850 may comprise an onboard processor 856, as well as onboard memory 858. The processor 856 may thus perform graphics processing, as commanded by the main processor 810. Moreover, the memory 858 may be significant, on the order of several hundred megabytes or more. Thus, once commanded by the main processor 810, the graphics processing unit 850 may perform significant calculations regarding graphics to be displayed on the display device, and ultimately display such graphics, without further input or assistance of the main processor 810.

Thus, it is upon illustrative computer system 800 that the various embodiments discussed above may be performed. Moreover, the various embodiments may be performed by a host of computer systems, such as computer system 800, operated in a parallel fashion.

It is noted that while theoretically possible to perform some or all the calculations, simulations, and/or modeling to arrive at the operational values and/or target values discussed above by a human using only pencil and paper, the time measurements for human-based performance of such tasks may range from man-hours to man-years, if not more. Thus, this paragraph shall serve as support for any claim limitation now existing, or later added, setting forth that the period of time to perform any task described herein less than the time required to perform the task by hand, less than half the time to perform the task by hand, and less than one quarter of the time to perform the task by hand, where "by hand" shall refer to performing the work using exclusively pencil and paper.

From the description provided herein, those skilled in the art are readily able to combine software created as described with appropriate general-purpose or special-purpose computer hardware to create a computer system and/or computer sub-components in accordance with the various embodiments, to create a computer system and/or computer sub-components for carrying out the methods of the various embodiments, and/or to create a non-transitory computer-readable storage medium (i.e., other than an signal traveling along a conductor or carrier wave) for storing a software program to implement the method aspects of the various embodiments.

The above discussion is meant to be illustrative of the principles and various embodiments of the present invention. Numerous variations and modifications will become apparent to those skilled in the art once the above disclosure is fully appreciated. It is intended that the following claims be interpreted to embrace all such variations and modifications.

What is claimed is:

1. A method comprising:

reading data associated with drilling of a first borehole, the reading during drilling of the first borehole and at least one datum of the data based on a controllable parameter;

calculating an operational value related to drilling the first borehole, the calculating in real-time with reading the data and the operational value based on the data;

determining a target value of the operational value, the determining in real-time with reading the data and the target value at least in part based on the data;

displaying a first borehole trajectory on a display device;

superimposing a first coordinate system over the first borehole trajectory on the display device, the superimposing proximate to a distal end of the first borehole trajectory; and plotting, within the first coordinate system, an indication of the operational value and an indication of the target value.

2. The method of claim 1 further comprising:

displaying on the display device a second borehole trajectory for a second borehole whose length is greater than the first borehole;

displaying a second coordinate system proximate to the second borehole trajectory; and plotting, within the second coordinate system, an indication of an actual value related to the second borehole, the actual value corresponding to the operational value of the first borehole.

3. The method of claim 1 further comprising, after the first borehole trajectory increases in relation to a depth associated with the plotting:

reading further data associated with drilling of the first borehole, the reading of further data during drilling of the first borehole and at least one datum of the further data based on a controllable parameter;

calculating a new operational value, the calculating in real-time with reading the further data and the new operational value based on the further data;

determining a new target value of the new operational value, the determining in real-time with reading the further data and the new target value at least in part based on the data;

moving the first coordinate system relative to the borehole trajectory, the moving based on increase of the first borehole trajectory; and plotting the new operational value and the new target value.

4. The method of claim 3 wherein moving the first coordinate system relative to the borehole trajectory further comprises at least one selected from the group consisting of: moving the coordinate system and leaving the first borehole trajectory stationary; and moving the first borehole trajectory and leaving the first coordinate system stationary.

5. The method of claim 3 further comprising refraining from removing the indication of the operational value and the target value from the display device.

6. The method of claim 1 further comprising adjusting, by a computer system, a controllable parameter responsive to a difference between the actual value and the target value.

7. The method of claim 1 wherein determining the target value further comprises determining by a processor disposed within the first borehole proximate the drill bit.

8. The method of claim 1 wherein superimposing the first coordinate system further comprises superimposing the first coordinate system having three-dimensions, the first coordinate system projected onto a two-dimensional surface of the display device.

9. The method of claim 1:

wherein calculating the operational value further comprises calculating an actual rate of penetration (ROP) of the of drill bit through a formation;

wherein determining a target value further comprises determining a target ROP;

wherein superimposing the first coordinate system further comprises projecting a three-dimensional coordinate system onto a two-dimensional surface of the display device, the three-dimensional coordinate system comprising a rotational speed axis, a drilling fluid flow rate axis, and a weight-on-bit axis; and wherein plotting further comprising plotting within the three-dimensional coordinate system an indication of the actual ROP and an indication of the target ROP.

10. The method of claim 9 further comprising:

displaying on the display device a second borehole trajectory for a second borehole whose depth is greater than the first borehole;

displaying a second coordinate system proximate to the second borehole trajectory; and plotting, within the second coordinate system, an indication of an actual ROP achieved during creation of the second borehole.

11. The method of claim 1 wherein superimposing the first coordinate system further comprises at least one selected from the group consisting of: superimposing the first coordinate system having only two dimensions; superimposing the first coordinate system having only three dimensions; superimposing the first coordinate system having only three dimensions, and including a fourth dimension in the form a visually recognizable artifact.

12. A drilling system comprising:

a drill string disposed within a first borehole, the drill string comprising a drill bit on a distal end thereof;

a computer system associated with the drill string, the computer system communicatively coupled to one or more sensors associated with drilling the first borehole;

a display device communicatively coupled to the computer system, the display device resides at the surface proximate the first borehole;

the computer system comprising a processor coupled to a memory, and the memory storing a program that, when executed by the processor, causes the processor to:

read data associated with drilling of the first borehole, at least one datum of the data based on a controllable parameter;

calculate an operational value related to drilling the first borehole, the calculating in real-time with reading the data and the operational value based on the data;

determine a target value of the operational value, the determining in real-time with reading the data and the target value based at least in part on the data; and cause the operational value and the target value to be displayed on the display device in relation to a first coordinate system, the first coordinate system shown on the display device proximate to a depiction of a trajectory of the first borehole.

13. The drilling system of claim 12 further comprising:

a telemetry module disposed within a bottom hole assembly of the drill string, the telemetry module sends information from within the first borehole to the surface;

wherein the computer system is disposed within the bottom hole assembly of the drill string; and wherein when processor causes the operational value and the target value to be displayed, the program causes the processor to send the operational value and the target value to the surface by way of the telemetry module.

14. The drilling system of claim 12 wherein the program further causes the processor to:

determine a difference between the operational value and the target value; and control at least one controllable parameter responsive to the difference.

15. The drilling system of claim 12 wherein the computer system is disposed at the surface at a location selected from the group consisting of: at the drilling site; and at a remote location relative to the drilling site.

16. The drilling system of claim 12 wherein when the processor causes the operational value and the target value to be displayed, the program further causes the processor to:

display the first borehole trajectory on the display device;

superimpose the first coordinate system over the first borehole trajectory on the display device, the first coordinate system proximate to a distal end of the first borehole trajectory on the display device; and plot, within the first coordinate system, an indication of the operational value and the an indication of the target value.

17. The drilling system of claim 16 wherein when the processor superimposes the first coordinate system, the program causes the processor to superimpose a three-dimensional first coordinate system projected onto a two-dimensional surface of the display device.

18. The drilling system of claim 12 wherein the program further causes the processor to:

display on the display device a second borehole trajectory for a second borehole whose depth is greater than the first borehole;

display a second coordinate system proximate to the second borehole trajectory; and plot, within the second coordinate system, an indication of an actual value related to the second borehole, the actual value corresponding to the operational value of the first borehole.

19. The drilling system of claim 12 wherein the program further causes the processor to:

read further data associated with drilling of the first borehole, the reading of further data during drilling of the first borehole and at least one datum of the further data based on a controllable parameter;

calculate a new operational value, the calculation in real-time with reading the further data and the new operational value based on the further data;

determine a new target value of the new operational value, the determination in real-time with reading the further data and the new target value based at least in part on the data;

move the first coordinate system relative to the borehole trajectory, the moving based on increase of the first borehole trajectory; and plot an indication of the new operational value and an indication of the new target value.

20. The drilling system of claim 19 wherein the program further causes the processor to refrain from removing the indication of the operational value and the indication of the target value from the display device.

21. The drilling system of claim 12:

wherein when the processor calculates the operational value, the program causes the processor to calculate an actual rate of penetration (ROP) of the of drill bit through a formation;

wherein when the processor determines a target value, the program causes the processor to determine a target ROP;

wherein when the processor sends the operational value and the target value, the program further causes the processor to send the actual ROP and the target ROP to be displayed on a three-dimensional coordinate system projected onto a two-dimensional surface of the display device, the three-dimensional coordinate system comprising a rotational speed axis, a drilling fluid flow rate axis, and a weight-on-bit axis.

22. A non-transitory computer-readable medium storing a program that, when executed by a processor, cause the processor to:

read data associated with drilling of a first borehole, the read during drilling of the first borehole and at least one datum of the data based on a controllable parameter;

calculate an operational value related to drilling the first borehole, the calculation in real-time with reading the data and the operational value based on the data;

determine a target value of the operational value, the determination in real-time with the read of the data and the target value based on the data;

display a first borehole trajectory on a display device;

superimpose a first coordinate system over the first borehole trajectory on the display device, the first coordinate system proximate to a distal end of the first borehole trajectory; and plot, within the first coordinate system, an indication of the operational value and an indication of the target value.

23. The non-transitory computer-readable medium of claim 22 further comprising:

displaying on the display device a second borehole trajectory for a second borehole whose depth is greater than the first borehole;

displaying a second coordinate system proximate to the second borehole trajectory; and plotting, within the second coordinate system, an indication of an actual value related to the second borehole, the actual value corresponding to the operational value of the first borehole.

24. The non-transitory computer-readable medium of claim 22 wherein the program further causes the processor to:

determine a difference between the operational value and the target value; and control at least one controllable parameter responsive to the difference.

25. The non-transitory computer-readable medium of claim 22 wherein, after the first borehole trajectory increases, the program further causes the processor to:

read further data associated with drilling of the first borehole, the read of further data during drilling of the first borehole and at least one datum of the further data based on a controllable parameter;

calculate a new operational value, the calculation in real-time with the read of the further data and the new operational value based on the further data;

determine a new target value of the new operational value, the determination in real-time with the read of the further data and the new target value based on the data;

move the first coordinate system relative to the borehole trajectory, the movement based on increase of the first borehole trajectory; and plot an indication of the new operational value and an indication of the new target value.

26. The non-transitory computer-readable medium of claim 25 wherein the program further causes the processor to leave the indication of the operational value and the target value on the display device.

27. The non-transitory computer-readable medium of claim 22:

wherein when the processor calculates, the program causes the processor to calculate an actual rate of penetration (ROP) of the of drill bit through a formation;

wherein when the processor determines, the program causes the processor to determine a target ROP;

wherein when the processor superimposes, the program causes the processor to project a three-dimensional coordinate system onto a two-dimensional surface of the display device, the three-dimensional coordinate system comprising a rotational speed axis, a drilling fluid flow rate axis, and a weight-on-bit axis; and wherein when the processor plots, the program causes the processor to plot an indication of the actual ROP and an indication of the target ROP.

28. The non-transitory computer-readable medium of claim 27 wherein the program further causes the processor to:

display on the display device a second borehole trajectory for a second borehole whose depth is greater than the first borehole;

display a second coordinate system proximate to the second borehole trajectory; and plot, within the second coordinate system, an indication of an actual ROP achieved during creation of the second borehole.

* * * * *